US006368413B1

(12) United States Patent
Charlet et al.

(10) Patent No.: US 6,368,413 B1
(45) Date of Patent: Apr. 9, 2002

(54) PROCESS FOR PREPARING IMPROVED SUGAR PRODUCT

(75) Inventors: Philippe Georges Charlet, Rio de Janeiro; Jorge Luiz Colodette, Vicosa; Carlos Roberto Xavier, Araraquara; Julio Cesar Mascioli, Rio de Janeiro, all of (BR)

(73) Assignees: Praxair Technology, Inc., Danbury, CT (US); Dulcini S/A, Sao Paolo (BR)

( * ) Notice: Subject to any disclaimer, the term of this patent is extended or adjusted under 35 U.S.C. 154(b) by 0 days.

(21) Appl. No.: 09/625,988

(22) Filed: Jul. 26, 2000

(51) Int. Cl.[7] ..... C13D 3/08
(52) U.S. Cl. ..... 127/46.1; 127/52; 127/55
(58) Field of Search ..... 127/52, 55, 46.1

(56) References Cited

U.S. PATENT DOCUMENTS 4,196,017 A * 4/1980 Melville et al. ..... 127/41
4,557,729 A * 12/1985 McDaniel, Jr. et al. ..... 8/111

OTHER PUBLICATIONS

Davis et al., "The Use of Ozone for Colour Removal at the Malelane Refinery", pp. 255–260, Proc. S. Afr Sug Technol. Assn (1998) 72 No month provided.
Chemical Engineering, "To produce whiter sugar, use ozone", p. 19 (Jan. 2000).
Vercellotti et al., "Color removal—chemical treatment", pp. 272–282, Sugar Industry Technologists Symposium (1998) No month provided.
Moodley et al., "Full scale decolourisation trials with ozone", pp. 165–170, Int. Sugar Jnl., (1999), No month provided vol. 101. No. 1203.
"Research And Development", pp. 4–15, Annual Report of the Sugar Milling Research Institute (1995) No month provided.
Purchase, "A survey of the current programme", pp. 235–240, Int. Sugar Jnl., (1996) No month provided vol. 98, No. 1169.
Fernandez et al., "Ozone As Decolorizing Agent of Sugar Industry Liquors", pp. 463–468 (1996), No month provided Ozone Research Center, National Center for Scientific Research, Havana, Cuba.

* cited by examiner

*Primary Examiner*—David Brunsman
(74) *Attorney, Agent, or Firm*—Donald T. Black

(57) ABSTRACT

Disclosed is a process for preparing an improved sugar product comprising (a) providing a raw sugar solution having color of 50 to 1,000 Icumsa units and a concentration of 10 to 70 Brix;

(b)(1) injecting ozone into the raw sugar solution while imparting agitation to the solution effective to reduce the size of said color-imparting particles into smaller particles, and then (b)(2) discontinuing said injection, but continuing said agitation for a period of time in excess of the duration of step (b)(1), wherein said smaller particles react with ozone, and (c) optionally repeating steps (b)(1) and (b)(2) at least once, wherein the solution is at no point subjected to a precipitation or carbonation step.

8 Claims, No Drawings

PROCESS FOR PREPARING IMPROVED SUGAR PRODUCT

BACKGROUND OF THE INVENTION

Raw sugar is made from sugar cane in a series of steps including the grinding of the cane from which raw juice is extracted. This raw juice is clarified through a combination of physical and chemical treatments such as carbonation and sulfitation. The resulting clarified juice undergoes a series of treatments (evaporation, crystallization and centrifugation) to obtain a raw sugar (in the form of sugar crystals that present a yellow color).

This raw sugar is then sent to a refinery where it is cleaned, purified and made ready for the consumer. The refining conventionally consists of a series of treatment steps where a raw sugar liquor is formed of the raw sugar, and color and non-sugar impurities are gradually eliminated from this liquor and pure sugar is produced. The refining process can produce a clear solution of sugar in water called liquid sugar, or solid refined sugar after crystallization.

The first step of the refining process is aimed at removing solids present in the raw sugar liquor while subsequent steps are performed to decolorize the liquor. The lightly colored liquor normally undergoes crystallization but it has to be evaporated prior to crystallization because it is too dilute. The raw sugar liquor can also be used to produce liquid sugar, and in this case it requires a final activated carbon filtration to remove turbidity and it normally has to be disinfected.

This series of steps in the refining stage has conventionally required costly installations such as a flotation system, filtration devices, activated carbon or resin columns, and regeneration installations. It also imposes high cost in the chemicals needed to remove solids and colored compounds. The disinfection of sugar liquors has conventionally been realized through the addition of biocides or antibiotics that also involve high costs.

The liquor that enters the refining stage still contains color compounds (by which is meant compounds that impart color to the sugar), and other fine particles, gums and resins. In conventional processing, the first step of processing the liquor is known as phosphatation where lime (or calcium saccharate) and phosphate are added to form a calcium phosphate (hydroxyapatite). That mineral acts as a matrix for entrapment of color compounds and other non-sugars. The thus-collected impurities are eliminated by filtration or flotation. Flotation is a more efficient technique. In that case air is injected and some polymers such as polyacrylamide are added to improve the elimination of impurities. These impurities are recycled because they still contain sugar that can be recovered.

The sugar liquor is then decolorized. Conventionally, this is done in refineries by absorption techniques wherein the liquor is pumped through columns of absorption medium (carbon or resins). The most common medium is based on the use of granular activated carbon but another option is to use an ion exchange resin. The carbon is regenerated in a hot kiln or simply discarded while the resin is regenerated chemically but produces liquid effluents.

The whole refinery sequence is considered as very effective to remove color and to produce a sugar of high quality, but it requires costly installed equipment, and high operational cost due to the use of chemicals and filtration medium.

It has been proposed in e.g. Davis et al., "The Use of Ozone for Colour Removal at the Malelane Refinery", Proc. S. Afr. Sug. Technol. Ass. (1998) 72, pp. 255–260, to decolorize sugar liquors by a method which includes the treatment of the sugar melt with ozone in a high shear mixer followed by carbonation of the liquor. According to this disclosure, the use of ozone in a single step is not sufficient to reach the required color reduction, and a carbonation treatment step is indispensable.

BRIEF SUMMARY OF THE INVENTION

The proposed invention is based on a simple process that will carry out the clarification and disinfection in one step. A second step may be included to remove the increase of turbidity.

The process comprises (a) providing a raw sugar solution having color of 50 to 1,000 Icumsa units and a concentration of 10 to 70 Brix, wherein said raw sugar solution contains particles imparting color to the solution, (b)(1) injecting ozone into the raw sugar solution while imparting agitation to the solution effective to reduce the size of said color-imparting particles into smaller particles, and then (b)(2) discontinuing said injection, but continuing said agitation for a period of time in excess of the duration of step (b)(1), wherein said smaller particles react with ozone, and (c) optionally repeating steps (b)(1) and (b)(2) at least once, wherein the solution is at no point subjected to a precipitation or carbonation step.

Ozone is applied into the raw sugar liquor in a mixing reactor, preferably a gas-liquid mixing system such as the "Advanced Gas Reactor" or AGR reactor sold by Praxair, Inc. and described in U.S. Pat. No. 5,244,063. Ozone is applied into the liquor in one or several injections (generally 1 to 6 and preferably 3 or 4) spaced apart in time.

During the ozone injection, and between each injection, and optionally but preferably also before the first ozone injection, mechanical agitation is imparted to the solution and maintained. The mechanical agitation reduces the size of the color-imparting particles to smaller particles.

This process clarifies and disinfects the sugar liquor. In an additional step, if desired, the material is filtered using, for example, a microfiltration device or other apparatus effective to remove turbidity from the solution.

Compared to the prior art this invention lowers the capital investment and operational costs required to produce clarified sugar.

In other aspects of the present invention, the process is carried out at 50 to 80° C., and the pH of the solution is maintained at 6.5 to 7.5.

The technical advantages of the process of the present invention include the decolorization and disinfection of sugar liquors with ozone to acceptable levels without the need for an additional carbonation or precipitation step as taught in the prior art.

DETAILED DESCRIPTION OF THE INVENTION

Sugar liquors usually contain a few crystals, vegetal fibers and pieces of bark and a lot of colored objects. Some are clusters of smaller structures that present a dark blue color under microscopic optical observation (1000 ×magnification). The average size of these clusters is about 10 square microns. The mechanical action provided for instance with a propeller type mixer such as the AGR, is necessary to break up these particles so that adding in the ozone realizes efficient oxidation for removing color. A simple contact column is not effective to reduce significantly the color of sugar liquor at the commonly encountered densities.

After ozonation accompanied by mechanical agitation as in the present invention, microscopic observation indicates that clusters are not present anymore but a lot of small components, much smaller, have been created in the medium. These small objects are uniformly scattered in the solution and they are responsible for an increase of turbidity. For some specific applications of liquid sugar this turbidity must be eliminated through simple microfiltration techniques.

Therefore, the decolorization process is based on a combination of a mechanical action such as that of propeller type device such as the AGR mixer and a powerful oxidation with ozone to obtain an effective color removal, followed preferably by a microfiltration step to remove turbidity.

The quantity of ozone needed to remove color depends on the initial color of the liquor and the required level of final color. This means that the ozone dosage should and can be determined experimentally for each type of sugar liquor. It is generally simpler, industrially, to operate in a batch mode than in a continuous process.

It has been discovered that considering the physical nature of colored compounds, ozone has to be applied in a reactor that will thoroughly mix the gas with the sugar. A propeller type reactor such as the AGR mixer can be used. It was observed that a better efficiency is obtained if ozone is injected directly into the liquor below the propeller, in the vortex zone.

The duration of an ozone injection step, and the length of time between injections of ozone while agitation continues, can vary somewhat depending on the sugar concentration, the degree of color before treatment begins, and the quantity of raw sugar liquor being treated. However, as a general guide, each ozone injection can last on the order of up to 5 minutes, preferably up to 2 minutes and more preferably up to 1 minute. When an ozone injection ceases, it is preferred that agitation is continued for longer than the injection lasted. Generally, agitation after an injection of ozone lasts on the order of up to 10 minutes, such as 5–8 minutes. A total of 1 to 6 ozone injections is generally adequate.

Preferably, the present invention includes

Controlling the pH of the liquor to a value of 6.5 to 7.5, preferably 7.0, by adding a small volume of a concentrated alkali (for example 2 millimoles of caustic soda per liter of sugar liquor at Brix 66)

Operating at temperature above 50° C. (but below 80° C.), preferably applying the ozone to the sugar liquor at about 700° C. The liquor can be prepared at this temperature and sent to the reactor. It is not necessary to maintain the liquor at the same temperature during the ozonation process.

Filtering the liquor after ozonation to remove turbidity, if desired, by a simple microfiltration step.

The proposed invention is applicable to all types of sugar liquors and melts that present a color between about 50 to 1000 Icumsa units, at a concentration between about 10 to 70 Brix. These sugar liquors may come from the refinery step or from another part of the process of sugar fabrication or alcohol production.

The ozone used for sugar liquor clarification and disinfection may be produced from an on-site generation system at concentrations between 3 to 15% in the gas stream. According to the initial level of color, ozone doses will vary in the range from 200 to 2000 g/L of sugar liquor at common Brix of 10–70.

EXAMPLES

In the laboratory, tests were performed on refinery liquors at Brix 66 to 70 and color between 60 and 300 Icumsa units (the color of sugar liquors is expressed in Icumsa units following the specific and standardized methodology well known in the sugar industry). A laboratory model generator was used to pass ozone into a batch reactor. The ozone generator was operating on a pure feed gas and it produced 40 g/h of ozone at 5% concentration. Two mixer reactors were used, the first one operating at 800 rpm under a pressure of 60 psig with 2L capacity and the second one operating at atmospheric pressure and 1200 rpm with 10 L capacity.

Full-scale experiments were performed at a liquid sugar company to clarify higher quantities of liquor. Two industrial ozone generators, 360 g/h ozone total capacity at 6% concentration were used to clarify liquors with a color between 400 and 600. 300 to 500 L of sugar liquor were treated in a batch reactor with a propeller running at 1700 rpm.

A series of tests were carried out with different types of liquors and the treated sugar was characterized in terms of color, turbidity, pH, saccharose degradation, toxicity and disinfection. The following examples present results of experiments performed in different ozonation conditions with different types of liquors.

Example 1

A reference sugar liquor with 204 Icumsa units color was treated in the laboratory with the pressurized mixer. Before ozone injection, caustic soda was added to the-sugar liquor. A 52 g/L solution was prepared and small volumes of this solution, 1.4 mL, were added, corresponding to about 2 mmoles per liter of sugar liquor.

The following table presents color reductions that can be reached with mechanical action treatment only and with ozone applied during the mixing.

| Ozone dose mg/L | Application time, min | Soda Application | Temperature, ° C. | Color | % Color reduction |
|---|---|---|---|---|---|
| 0 | 20 | 0 | 25 | 170 | 17 |
| 0 | 8 | 0 | 70 | 201 | 1.5 |
| 200 | 8 | 1.4 | 70 | 57 | 72 |

These tests demonstrate that a mechanical action treatment is not able to reduce color when no ozone is applied (duration of test 8 min). When the mechanical action treatment is maintained during a longer time (20 min) a low but significant reduction of color is observed. This is a confirmation of the idea that some clusters of color exist in the sugar liquor and that a pure mechanical action can help to reduce color; but basically the color removal is due to an oxidation of compounds by ozone.

Example 2

A liquor with 193 Icumsa color units was treated with ozone using the pressurized mixer under different ozonation conditions. The results are presented in the next table.

Application times reported in the table took into account the ozone injection time and the agitation time following cessation of the ozone injection. In each case in this example and in the following examples, unless indicated otherwise, ozone was injected for 1 minute with agitation, and then the ozone injection stopped but agitation continued for another 7 minutes, resulting in a total cycle time of 8 minutes. For instance, 400 ppm of ozone were applied in two stages: 200 mg/L with 8 min of application and then another dose of 200 mg/L during another 8 min period. 600 mg/L were applied in 3 sequences each totalling 8 min.

| Ozone dose mg/L | Application time, min | Soda application | Ozone consumption, % | Color | % Color reduction |
|---|---|---|---|---|---|
| 0 | — | — | — | 193 | — |
| 200 | 1 × 8 | 1 × 1.4 | 92 | 50 | 71 |
| 400 | 2 × 8 | 1 × 1.4 | 88 | 42 | 76 |
| 400 | 2 × 8 | 2 × 1.4 | 89 | 25 | 85 |
| 400 | 2 × 12 | 1 × 1.4 | 95 | 34 | 81 |
| 600 | 3 × 8 | 3 × 1.4 | 87 | 32 | 82 |

These results indicate that this reactor is very efficient and that ozone readily reacts with the sugar liquor. High color reductions were obtained and final color levels can be considered as very low (a good clarified liquor presents a color less than 45 Icumsa units). These results also show that ozone dosage is not the major parameter; the use of repeated sequences of short pulses of ozone injection, the application time and the control of the pH during the ozonation reaction are also important factors to remove color.

Example 3

A relatively clear liquor (95 Icumsa units) was treated with 400 mg/L of ozone but with different conditions of application. Results are presented in the next table. In the test reported in the last line, and in other tests reported in the following examples, which indicate ozone application of 2×12, ozone was injected for 1 minute and then the solution was agitated without ozone injection for the next 11 minutes.

| Ozone dose mg/L | Application time, min | Soda application | Color | Color reduction, % |
|---|---|---|---|---|
| 0 | — | — | 95 | — |
| 400 | 2 × 8 | 1 × 2.8 | 22.5 | 77 |
| 400 | 2 × 8 | 2 × 1.4 | 16 | 82 |
| 400 | 2 × 12 | 1 × 1.4 | 22.5 | 77 |

A specific dose of caustic soda was applied before each ozone dosage. In that case, higher color reductions were obtained when compared with the application of a unique dose of caustic soda or increasing the application time of ozone in the mixing system.

Example 4

A sugar liquor with a color of 193 Icumsa units was treated in the laboratory under different ozonation conditions. The next table presents the levels of color and turbidity obtained.

| Ozone dose mg/L | Application time, min | Soda application | Turbidity NTU | Color | % Color reduction |
|---|---|---|---|---|---|
| 0 | — | — | 8 | 193 | — |
| 200 | 1 × 8 | 1 × 1.4 | 18 | 50 | 71 |
| 400 | 2 × 8 | 1 × 2.8 | 16 | 34 | 76 |
| 400 | 2 × 8 | 2 × 1.4 | 17 | 25 | 85 |
| 400 | 2 × 12 | 1 × 1.4 | 12 | 34 | 81 |
| 600 | 3 × 8 | 3 × 1.4 | 19 | 32 | 82 |

These results show that the ozone treatment reduced color but also created turbidity. This is in accordance with the fact that the mechanical action breaks color-imparting clusters and particles into smaller-sized particles, and allows ozone to oxidize the smaller components thus produced; but, on the other hand, it creates turbidity.

Example 5

A series of ozonation experiments was performed on a sugar liquor with 193 color units, applying different dosages of ozone under different conditions. The quality of the ozonated sugar was assessed through chromatographic analyses of saccharose.

| Ozone dose mg/L | Application time, min | Soda application m/L | Color | Presence of glucose and fructose | Saccharose degradation % |
|---|---|---|---|---|---|
| 0 | — | — | 193 | No | 0 |
| 200 | 1 × 8 | 1 × 1.4 | 50 | No | 0 |
| 400 | 2 × 8 | 1 × 1.4 | 42 | No | 0 |
| 400 | 2 × 8 | 1 × 2.8 | 34 | No | 0 |
| 400 | 2 × 8 | 2 × 1.4 | 25 | Yes | 0.7 |
| 400 | 2 × 12 | 1 × 1.4 | 34 | No | 0 |
| 600 | 3 × 3 | 1 × 1.4 | >150 | No | 0 |
| 600 | 3 × 8 | 1 × 1.4 | 60 | Yes ? | ? |
| 600 | 3 × 8 | 3 × 1.4 | 32 | Yes | 0.2 |

The degradation of saccharose results in the formation of glucose and fructose. These results indicate that ozonation is responsible only for a small degradation of sugar in a very few cases.

Example 6

A 184 Icumsa color units liquor was treated with 200 mg/L of ozone during 8 min using the pressurized reactor. Results of disinfection are presented in the next table.

| Sample | Color | Aerobic Bacteria, CFU/g | Yeast and Molds, CFU/g |
|---|---|---|---|
| Raw | 184 | $1.2 \times 10^3$ | <10 |
| Ozonated | 49 | 65 | <10 |

Results indicate that the initial level of contamination of the liquor was low, due to the low water activity. After ozonation the number of total bacteria was significantly reduced (95%) even applying a low dose of ozone.

Example 7

A low color liquor, 64 Icumsa units was treated in the atmospheric pressure reactor under two different ozonation conditions. The following table presents the results of microbiological analyses.

| Sample | Color | Aerobic Bacteria, CFU/g | Yeast and Molds, CFU/g |
|---|---|---|---|
| Raw | 64 | $1.95 \times 10^2$ | <10 |
| Ozonated, 200 mg/L | 27 | 20 | <10 |
| Ozonated, 400 mq/L | 11 | <10 | <10 |

Results show that a complete disinfection was realized applying 400 mg/L of ozone, but even with 200 mg/l a reduction of 89% was reached and a low color as obtained.

Example 8

A clear sugar liquor with an initial color of 95 units was treated with ozone to a low level of color and the toxicity was determined using the Microtox apparatus. Toxicity results are expressed in Effective Concentration 50, that is to say the percent of effluent that cause a 50 reduction of the emitted light by the luminescent bacteria.

| Sample | Color | Color reduction, % | Saccharose degradation | Acute toxicity, $EC_{50}$, 15 min, % |
|---|---|---|---|---|
| Raw | 95 | — | — | >100 |
| Ozonated, 400 mg/L, 2 × 12 min | 22.5 | 77 | no | >100 |

These data indicate that it is possible to clarify the liquor to a very low level without degradation of sugar and no formation of acute toxic compounds. Even with the pure ozonated liquor, no decrease of bacteria light was observed.

Example 9

300 L of a relatively high color melt, at Brix 67, was treated in the semi-industrial reactor, at 580° C. Caustic soda was added at the beginning of the test and a dose was added at every 20 min step. Samples of the treated liquor were collected and analyzed during the test. After ozonation the liquor was filtered on a 0.6 lam cellulose/diatomaceous earth (microfiltration). The following table presents the results of color reduction.

| Application time min | Dose of ozone, mg/L | pH | Turbidity | Color | % color reduction |
|---|---|---|---|---|---|
| 0 | 0 | 6.0 | 30.5 | 503 | — |
| 20 | 300 | 6.6 | 39 | 326 | 35 |
| 40 | 600 | 6.7 | 45.5 | 147 | 71 |
| 60 | 900 | 6.8 | 49 | 95 | 81 |
| 80 | 1200 | 6.9 | 55 | 74 | 85 |
| 120 | 1800 | 6.8 | 59 | 56 | 89 |
| Filtration step | — | 6.8 | 0.5 | 56 | 89 |

Considering the initial color, the dose of ozone to apply to decolorize the liquor is higher than for the previous samples. Due to limitation in the production of ozone it was necessary to apply ozone during a long time. These data show that it is easy to remove color at the beginning of the test but it becomes more difficult when the liquor is clear; the same dose of ozone reduces less and less color at the end of the test. A full-scale reactor is able to produce a clarified liquor at the ideal pH but with an increase of the turbidity. This confirms the fact that color removal is related to the increase of the turbidity. The filtration leads to a very low turbidity liquor.

Example 10

A similar experiment to the previous one was conducted on a melt with an initial color of 574 Icumsa units. Ozone was applied during 100 min.

| Application time min | Dose of ozone, mg/L | pH | Turbidity | Color | % color reduction |
|---|---|---|---|---|---|
| 0 | 0 | | 37.5 | 574 | — |
| 20 | 300 | | — | 324 | 44 |
| 40 | 600 | | — | 162 | 72 |
| 60 | 900 | | — | 103 | 82 |
| 80 | 1200 | | — | 87 | 85 |
| 100 | 1500 | | 49 | 45 | 92 |

A higher dosage of ozone allows obtaining a clarified liquor with a low final color, more than 90% of the color was removed applying 1.5g/L of ozone in the reactor mixer.

What is claimed is:

1. A process for preparing an improved sugar product comprising (a) providing a raw sugar solution having color of 50 to 1,000 Icumsa units and a concentration of 10 to 70 Brix, wherein said raw sugar solution contains particles imparting color to the solution, (b)(1) injecting ozone into the raw sugar solution while imparting agitation to the solution effective to reduce the size of said color-imparting particles into smaller particles, and then (b)(2) discontinuing said injection, but continuing said agitation for a period of time in excess of the duration of step (b)(1), wherein said smaller particles react with ozone, and (c) optionally repeating steps (b)(1) and (b)(2) at least once, wherein the solution is at no point subjected to a precipitation or carbonation step.

2. A process according to claim 1 wherein steps (b)(1) and (b)(2) are carried out 1 to 6 times.

3. A process according to claim 1, further comprising filtering the solution.

4. A process according to claim 1 wherein the temperature of the solution is 50 to 80° C.

5. A process according to claim 1 further comprising maintaining the pH of the solution at 6.5 to 7.5.

6. A process according to claim 1 wherein said agitation is imparted by a propeller.

7. A process according to claim 1 wherein color reduction of at least 80% within 60 minutes and sugar disinfection are achieved.

8. A process according to claim 1 wherein, before ozone is injected into the raw sugar solution, agitation is imparted to the raw sugar solution effective to reduce the size of particles in the solution.

* * * * *